United States Patent [19]

Bellow, Jr. et al.

[11] Patent Number: 4,828,575

[45] Date of Patent: May 9, 1989

[54] DRYING LOW RANK COAL AND RETARDING SPONTANEOUS IGNITION

[75] Inventors: Edward J. Bellow, Jr., Princeton, N.J.; John C. Bixel, Newtown, Pa.; William F. Heaney, Jamison, Pa.; Tsoung Y. Yan, Philadelphia, Pa.

[73] Assignee: Mobil Oil Corporation, New York, N.Y.

[21] Appl. No.: 68,007

[22] Filed: Jun. 30, 1987

[51] Int. Cl.[4] ..... C10L 5/00; C10L 5/24

[52] U.S. Cl. ..... 44/501; 44/626

[58] Field of Search ..... 44/1 R, 1 G, 6, 626, 44/501; 34/12

[56] References Cited

U.S. PATENT DOCUMENTS

| | | | |
|---|---|---|---|
| 4,265,637 | 5/1981 | Anderson | 44/1 G |
| 4,401,436 | 7/1983 | Bonnecaze | 44/1 G |
| 4,402,707 | 9/1983 | Wunderlich | 44/6 |
| 4,421,520 | 12/1983 | Mathews | 44/6 |
| 4,650,495 | 3/1987 | Yan | 44/1 G |

FOREIGN PATENT DOCUMENTS

| | | | |
|---|---|---|---|
| 37960 | 4/1965 | German Democratic Rep. | 44/501 |
| 217592 | 12/1983 | Japan | 44/501 |

*Primary Examiner*—Carl F. Dees

*Attorney, Agent, or Firm*—Alexander J. McKillop; Charles J. Speciale; Van D. Harrison, Jr.

[57] ABSTRACT

Particulate coal is rendered less subject to spontaneous ignition by simultaneously spraying or otherwise contacting it and cooling it with an aqueous emulsion in water of a light cycle oil, heavy cycle oil, clarified slurry oil, durene, and other carbonaceous materials derived from coal liquefaction and petroleum refining. Aqueous polymer emulsions and oxidation inhibitors can also be used.

11 Claims, No Drawings

DRYING LOW RANK COAL AND RETARDING SPONTANEOUS IGNITION

NATURE OF THE INVENTION

This invention relates to improved methods for producing a dried particulate coal fuel having a reduced tendency to dust and to ignite spontaneously. More specifically, it relates to a method for drying coals, particularly low rank coals, and passivating them with an applied liquid to render them less susceptible to dusting and spontaneous ignition.

BACKGROUND OF THE INVENTION

Low rank coals, such as lignite and sub-bituminous coal are readily available. They may, however, have such high moisture contents and low heating values that they cannot be used as fuels in existing boilers without derating or significant modifications. These coals can be upgraded by thermal drying to reduce the moisture contents and heating values sufficiently that the dried coals may compete favorably with many bituminous coals. With a low sulfur content such coals can meet clean air requirements for many power plants without new flue gas desulfurization systems and make a major contribution to reducing sulfur dioxide emissions and acid rain. The drying required with such low rank coals is a deep drying process which removes both surface water and large quantities of interstitial water present. The handling, storage and transportation of such deep dried coals can present technical problems resulting from the friability and dustiness of the coals, as well as their tendencies to readsorb moisture and react with oxygen from the air. Spontaneous combustion can result from heats of moisture readsorption and oxidation. Removing moisture inherent in the coals structures can also reduce the strength of the coal particle by cracking or fissuring, causing friability and dusting. The number of active surface sites exposed within the coal particles can also thus be increased, thereby increasing undesired moisture adsorption and oxidation.

Drying conditions such as temperature, residence time within the drying chamber, drying gas velocities, etc., affect the tendencies of the dried coal product to exhibit the undesirable qualities discussed above. For example, rapid removal of moisture by a high drying temperature can cause what is commonly called "the popcorn effect"—the fissuring and cracking and disintegration of the coal particles. Drying the coal and removing the moisture at a slower rate can reduce this effect—preventing disintegration and allowing moisture to escape in a manner that reduces cracking and fissuring. Smaller fissures make the coal particles more amenable to surface treatment agents which block the pores or coat the particle surfaces and act as effective oxidation or moisture readsorption inhibitors. However, slower drying rates necessitate longer residence times in the drying chamber to achieve the same degree of moisture removal. Because of the turbulent action in a fluidized drying bed, longer residence time leads to increased mechanical size-degradation of the coal particles, increasing dust in the dried product.

SUMMARY OF THE INVENTION

Briefly stated, this invention comprises heating and drying particulated sub-bituminous or lignitic coal under specified conditions of temperature and residence time in the dryer. Thereafter the heated dried particulated coal simultaneously is cooled and coated by contacting it with an aqueous emulsion of a passivating agent, thereby reducing tendencies of the particulated coal to re-adsorb moisture, to dust and/or to spontaneously ignite. The passivating agent is an aqueous emulsion (water is the continuous phase) of a heavy cycle or light cycle oil, a mixture of these cycle oils, a clarified slurry oil, other petroleum resids, fuel oils and asphalts derived in the refining of petroleum hydrocarbons or other hydrocarbon materials as well as coal tar and pitches derived from coking, gasification or liquefaction. The aqueous emulsion can also be one containing as the discontinuous phase distillate or residuum from the liquefaction of coal, durene, diesel or other hydro carbon materials derived from the conversion of methanol to liquid hydrocarbon fuels.

DETAILED DESCRIPTION OF THE INVENTION

This invention is an improved method of reducing the tendency of dried particulated coal to disintegrate and ignite spontaneously. Coals may be dried to remove surface water or deep dried to remove interstitial water and thereby increase the heating value of the coal. In this description dried coal is coal that has been dried to remove some of the interstitial water and the moisture content of a dried coal as measured in accordance with the procedures set forth in ASTM D3175-73 entitled "Standard Test Method For Moisture in the Analysis Sample of Coal and Coke" published in the 1978 Annual Book of ASTM Standards, Part 26. Techniques for drying coal are discussed in U.S. Pats. Nos. 4,396,394 and 4,402,707 both of which are incorporated herein by reference. The method of this invention is applicable to all forms of dried coal, especially deep dried coal, but is especially useful for dried low rank coals such as sub-bituminous, lignite and brown coals.

In the method of this invention, the coal particles are first reduced to particles having a maximum diameter of 1 to 4 inches with an average diameter of about 0.2 to 0.5 inches. The particulated coal is then contacted with a heated stream of drying gas, preferably in a fluidized bed, at a temperature between about 190° F. and 230° F., (preferably 200° F. to 215° F.) for a contact period of between 1 and 15 minutes (preferably 3 to 7 minutes) so that the rate of evaporation of water is about 0.1 to 0.5 tons per hour (preferably 0.17 to 0.22 tons per hour) per tone of raw coal. The techniques for drying the particulated coal are set forth in the U.S. Pats. Nos. 4,396,394 and 4,402,707 noted previously. The dried particulated coal is then sprayed with the emulsion of hydrocarbon oil which is an emulsion of a heavy or light cycle oil, a mixture of these, a slurry oil or combinations thereof derived from the petroleum refining process. Cycle oil is the predominantly aromatic fraction obtained from the catalytic cracking of petroleum fraction and having a boiling range of 400° F. to 900° F. Heavy cycle oil is that portion of cycle oil boiling between 700° F. and 900° F. Light cycle oil is that portion of cycle oil boiling between 400° F. and 700° F. Clarified slurry oil is the highly aromatic fraction from catalytic cracking which boils above 900° F. In addition, hydrocarbon oils derived from the liquefaction and gasification of coal, either raw or upgraded, are suitable.

Preferably the oil has a characterization factor greater than 10.0. The characterization factor is a special physical property of hydrocarbons defined by the relationship:

$$K = T_b^{\frac{1}{3}}/G$$

where

K—Characterization factor $T_b$=Cubic average boiling point °R.

G=Specific gravity 60° F./60° F.

R=° F.+460.

The cubic average boiling point is determined in accordance with the calculations mentioned in an article entitled "Boiling Points and Critical Properties of Hydrocarbon Mixtures," by R. L. Smith and K. M. Watson, appearing in Industrial and Engineering Chemistry, Volume 29, pages 1408–1414, December, 1937, and using the ten, thirty, fifth, seventy, and ninety percent points ° F. as measured by the procedures of ASTM D1160-77, previously described or ASTM D86 entitled "Standard Method for Distillation of Petroleum Products", published in the 1978 Annular Book of ASTM Standards, Part 23. ASTM D86 is for products which decompose when distilled at atmospheric pressure.

Accordingly, in the method of this invention after the dried coal particles have been removed from the drying system they are conveyed to a cooling zone where they are cooled and coated simultaneously by an aqueous emulsion of hydrocarbon passivating agent. The aqueous emulsion treating agent of this invention can be used in any desired quantity, but between 0.2 and 20 gallons of liquid per ton of dried coal will ordinarily be adequate. The preferred range is between 0.5 and 2 gallons of oil per tone of dried coal.

The ratio of water to hydrocarbon in the emulsion can be between 10 to 90 parts by weight of water to 90 to 10 parts of hydrocarbon.

As noted above, the hydrocarbon passivating component of the aqueous emulsion is a petroleum- or coal-derived material such as light or heavy cycle oil or other petroleum resid oil, clarified slurry oil, tar, pitches or durene from the conversion of methanol to gasoline.

As for the emulsifying agent, any of those known to the prior art which will lead to the emulsification of oil in water can be used. Petroleum sulfonates can be used as emulsifiers which can be prepared separately or insitu through sulfonation of the resids or aromatic hydrocarbons. We have found the commercially available rosin and tall oil soaps such as those sold under the tradename "Unitol" to be particularly useful as the emulsifying agent in preparing emulsions of the heavier resids. The sodium soap of these two acids is most preferred. Emulsions prepared with the tall oil and rosin soaps do no invert after prolonged storage and are otherwise very stable. The amount of emulsifier to be used can best be determined experimentally for the particular composition to be used. The emulsions can be mixed in any commercial emulsifying equipment.

Compositions and properties of some of these tall oils are as follows:

TABLE

| Description | Trade Name: ACD Low Rosin Tall Oil | DSR Tall Oil Fatty Acid | DT-30 Distilled Tall Oil | NCY Tall Oil Rosin |
|---|---|---|---|---|
| Composition, % | | | | |

TABLE-continued

| Description | ACD Low Rosin Tall Oil | DSR Tall Oil Fatty Acid | DT-30 Distilled Tall Oil | NCY Tall Oil Rosin |
|---|---|---|---|---|
| Fatty acid | 97.4 | 92 | 50 | 3.7 |
| Rosin acid | 0.6 | 5.2 | 33.1 | 92.4 |
| Unsaponifiables | 2 | 2.8 | 2.9 | 3.9 |
| Properties | | | | |
| Acid no. | 193 | 190 | 172 | 164 |
| Saponification No. | 195 | 192 | 178 | 172 |
| Iodine No. | 130 | 132 | — | — |
| Soften Point, °C. | — | — | — | 72 |

To effect the simultaneous cooling and treating of the heated particulated coal, it is conducted from the heating dry zone to a zone where it is sprayed with the oil in water emulsion. The emulsion can be further atomized by injecting with it a volume of air to augment cooling and to more finely disperse the spray. Generally the volume of air used to atomize the emulsion measured at standard conditions can range from 0.1 to 10 pounds per pound of emulsion. The heat content of the hot dried coal is sufficient to vaporize the water in the sprayed emulsion thereby cooling the coal particles and effecting dispersion of the emulsion component on the particles.

A preferred method of treating the hot dried coal is to carry it to a fluidized bed wherein the fluidizing gas can be a cooling gas and the emulsion can be sprayed into the fluidized bed with the fluidizing gas.

After the particles of coal have been cooled and treated they are transported to storage for subsequent use.

In addition to the treating agents derived from petroleum refining and coal extracts, other aqueous emulsions can also be used such as polymer emulsions, natural and synthetic latex, oxidation inhibitors, etc.

What is claimed is:

1. A method of passivating and cooling heated dried coal comprising:

(a) heating particulate coal to a temperature between about 190 and about 230° F. to dry to the desired level: and (b) coating the resulting heated particulate coal with an aqueous emulsion of a hydrocarbon selected from the group consisting of petroleum resid, light cycle oil, heavy cycle oil, clarified slurry oil, durene, asphaltenes, coal tar and coal tar pitch.

2. The method of claim 1 wherein the aqueous emulsion comprises about 10 to 90% by weight of water and about 90 to 10% by weight of hydrocarbon oil.

3. The method of claim 1 wherein the aqueous emulsion also contains between about 0.001 and about 5% by weight of emulsifying agent.

4. The method of claim 3 wherein the emulsifying agent is selected from the group consisting of soaps of tall oil, rosin, petroleum sulfonates, liqnin sulfonates, and dodecylbenzenesulfonate.

5. The method of claim 3 wherein the emulsifying agent is selected from the group consisting of salts of petroleum sulfonic acids.

6. The method of claim 3 wherein the emulsifying agent is dodecylbenzenesulfonate.

7. The method of claim 1 wherein the characterization factor of the hydrocarbon oil is greater than about 10.

8. The method of claim 1 wherein step (b) comprises simultaneously coating the resulting heated particulate coal with an aqueous emulsion of a hydrocarbon oil and cooling the heated particulate coal.

9. The method of claim 1 wherein the heated particulate coal is contacted with the emulsion in a ratio of between about 0.2 to about 20 gallons of emulsion per ton of coal.

10. The method of claim 1 wherein water is the continuous phase in the water/oil emulsion.

11. A method for passivating and cooling heated dried coal comprising:

(a) heating particulate coal to a temperature between about 190 and about 230° F. to dry the coal to the desired level; and (b) simultaneously coating the resulting heated particulate coal with an aqueous emulsion of a hydrocarbon oil and cooling the heated particulate coal in a separately removed fluidized bed.

* * * * *